US007294975B2

(12) United States Patent
Chou et al.

(10) Patent No.: US 7,294,975 B2
(45) Date of Patent: Nov. 13, 2007

(54) METHOD FOR CONTROLLING AN INVERTER UNDER ALTERING VOLTAGE

(75) Inventors: Chin-Wen Chou, Hsin-Tien (TW); Ying-Nan Cheng, Hsin-Tien (TW); Chin-Biau Chung, Hsin-Tien (TW)

(73) Assignee: Zippy Technology Corp., Taipei Hsien (TW)

( * ) Notice: Subject to any disclaimer, the term of this patent is extended or adjusted under 35 U.S.C. 154(b) by 143 days.

(21) Appl. No.: 11/092,592

(22) Filed: Mar. 29, 2005

(65) Prior Publication Data

US 2006/0220594 A1 Oct. 5, 2006

(51) Int. Cl.
*H05B 37/02* (2006.01)

(52) U.S. Cl. ..... 315/291; 315/DIG. 4; 315/307; 315/282

(58) Field of Classification Search ..... 315/291, 315/224, DIG. 2, DIG. 4, 209 PZ, DIG. 5, 315/DIG. 7, 307, 308, 277, 282
See application file for complete search history.

(56) References Cited

U.S. PATENT DOCUMENTS 5,612,595 A * 3/1997 Maheshwari ..... 315/DIG. 4
5,930,121 A * 7/1999 Henry ..... 315/307
6,198,234 B1 * 3/2001 Henry ..... 315/291
6,809,938 B2 * 10/2004 Lin et al. ..... 315/307
6,839,253 B2 1/2005 Chou et al. ..... 345/102
2005/0156534 A1 * 7/2005 Oh ..... 315/291
2006/0175983 A1 * 8/2006 Crouse et al. ..... 315/291

* cited by examiner

*Primary Examiner*—Douglas W. Owens
*Assistant Examiner*—Ephrem Alemu
(74) *Attorney, Agent, or Firm*—Birch, Stewart, Kolasch & Birch, LLP

(57) ABSTRACT

A method for controlling an inverter under altering voltage aims to change the electric conductive interval of the electric conductive cycle of the inverter corresponding to alteration of an input voltage so that the dimming duty cycle, electric conductive cycle and transformer oscillation duty cycle of the inverter can be maintained at a selected level. Thereby when the input voltage is altered, the existing dimming range can be maintained and actuation electricity output is stabilized. The transformer can be protected and the life span of the load can be extended.

20 Claims, 10 Drawing Sheets

METHOD FOR CONTROLLING AN INVERTER UNDER ALTERING VOLTAGE

FIELD OF THE INVENTION

The present invention relates to a method for controlling an inverter under altering voltage and particularly to a method to change the electric conductive interval of the electric conductive cycle of the inverter to maintain the existing dimming range and stabilize actuating electric output and protect the life span of transformers and loads.

BACKGROUND OF THE INVENTION

Backlight module is a key element of the actuating light source of a display panel. Besides, providing a lighting source, the dimming function to alter the actual light projection effect in response to the environment illuminating condition is the basic function of the backlight module in practical applications.

The actuating electric source for the backlight modules now on the market mostly adopts high voltage inverters. They can be classified in current feeding push-pull parallel resonant inverters and single stage inverters. The transformers used in the inverters include winding transformers and piezoelectric transformers. Their duty cycle waveforms are shown in FIGS. 1A and 2A (FIG. 1A is a burst mode dimming method, FIG. 2A is a standby mode dimming method, technical details can be found in U.S. Pat. No. 6,839,253). For discussion purpose, assuming input voltage is DC 10V, the dimming efficiency (dimming duty cycles are 1*a* and 1*c*) is 100%, then the electric conductive interval of the electric conductive cycles 2*a* and 2*c* is 50% ON and 50% OFF. The transformer oscillation duty cycles 3*a* and 3*c* are 100% sinuous waveform based on the amplitude of 10V. Assuming the load (cold cathode lamp) outputs a lamp feedback current of 6 mA, when the input voltage is altered to 20V, as shown in FIGS. 1B and 2B, the existing dimming mechanism relatively increases the lamp feedback current (such as 12 mA) when the input voltage alters. In order for the backlight module to maintain the illumination at the existing dimming efficiency, the lamp current feeds back electricity to the dimming controller (or getting a voltage feedback electricity from the transformer output end or input end as the comparison value). By comparing the feedback electricity with a reference value built in the dimming controller, a second dimming duty cycle is determined. As shown in the drawings, when the input voltage is altered to DC of 20V, the dimming duty cycles 1*b* and 1*d* are transformed to 50% ON and 50% OFF. The electric conductive cycles 2*b* and 2*d* are changed to 50% ON and 50% OFF when the electric conductive interval is maintained 50% ON and 50% OFF. The transformer oscillation duty cycles 3*a* and 3*d* are 50% ON and 50% OFF at the amplitude of 20V. Referring to FIGS. 3A and 4A, the input voltage is DC 10V, the dimming efficiency (dimming duty cycles 1*e* and 1*g*) is 50%. FIGS. 3B and 4B show that the input voltage is DC 20V, the dimming efficiency (dimming duty cycles 1*f* and 1*h*) is changed to 25%. The assumed conditions for the rest electric conductive cycles 2*e*, 2*g*, 2*f* and 2*h*, and the oscillation duty cycles 3*e*, 3*g*, 3*f* and 3*h* are same as previously discussed. While such a dimming control mechanism can maintain the existing efficiency and illumination for the cold cathode lamp, as shown in the drawings, there are still drawbacks, notably:

1. As the dimming duty cycle is squeezed, the actual applicable dimming range of the backlight module is affected. As shown in FIG. 3B, the applicable dimming range of the existing backlight module mostly is between 20% and 100%. But when the input voltage has great alterations, the transformer that originally has 50% of dimming efficiency could result in a single sinuous waveform at 25%. As a result, the backlight module cannot continuously correct the dimming efficiency downwards, Hence the actual dimming efficiency range is limited between 50% and 100%, not the original setting of 20% to 100%.

2. The oscillation amplitude of the transformer and actuator is changed (such as from 10V to 20V) when the input voltage is altered. This will shorten the life span of the transformer and actuator.

3. When the input voltage fluctuates greatly and is not stable, the lamp current of the cold cathode lamp will generate a higher waveform factor. As a result, blacking phenomenon is easily occurred to the ignition end of the cold cathode lamp.

SUMMARY OF THE INVENTION

Therefore the primary object of the present invention is to solve the aforesaid disadvantages occurred to the conventional techniques of altering dimming duty cycle under the varying input voltage. The present invention alters the electric conductive interval of the electric conductive cycle without changing the dimming duty cycle, electric conductive cycle and transformer oscillation duty cycle to maintain the existing dimming range and a constant voltage amplitude oscillation of the transformer, and generate symmetrical and even lamp current on the load (cold cathode lamp) so that the life span of the transformer and load can be maintained without suffering.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1A:
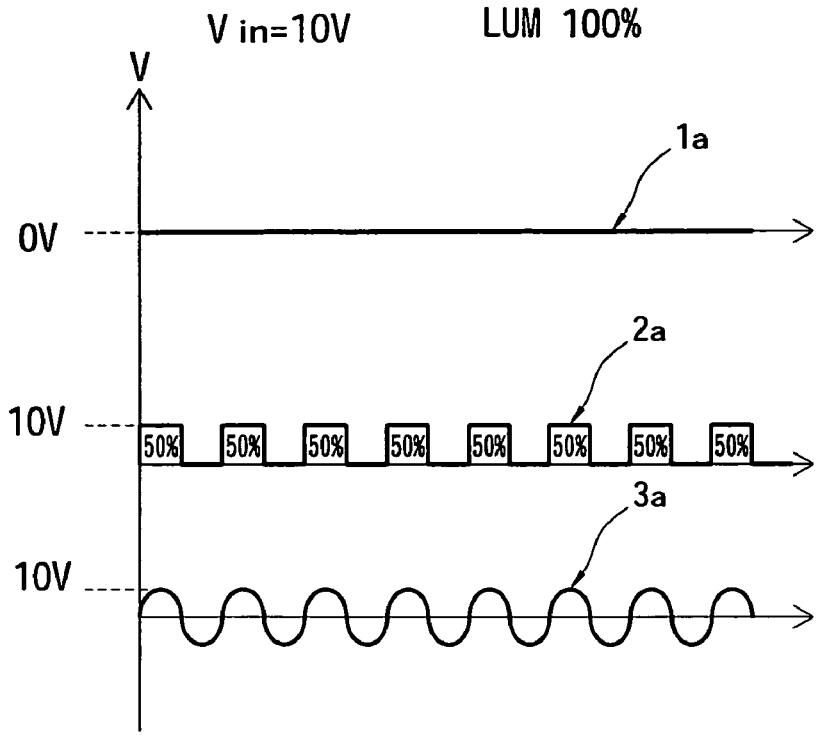
Fig.1A PRIOR ART
FIGS. 1A through 4B are schematic views of duty cycles of conventional dimming mechanisms.
Figure 1B:
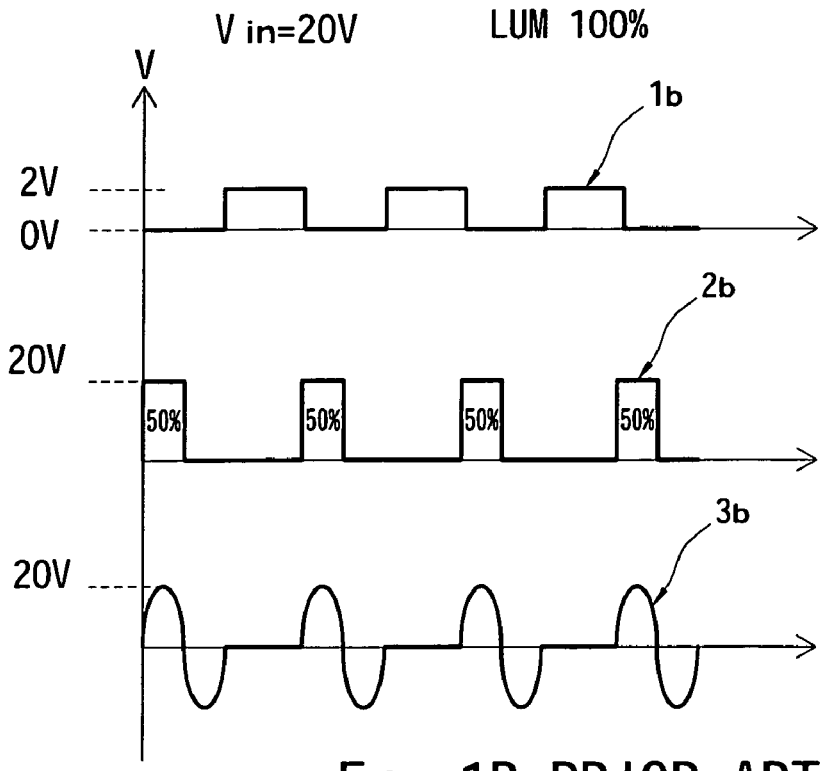
Fig.1B PRIOR ART
Figure 2A:
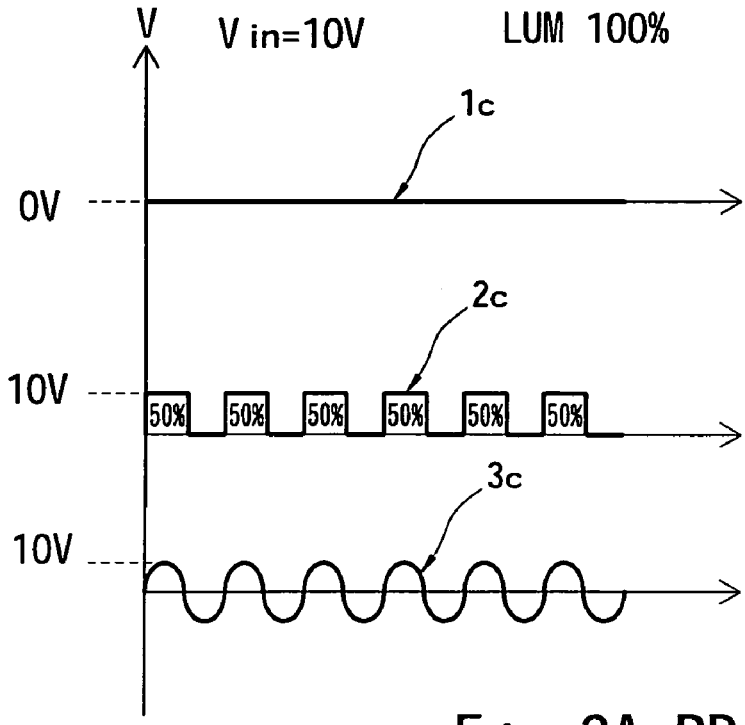
Fig.2A PRIOR ART
Figure 2B:
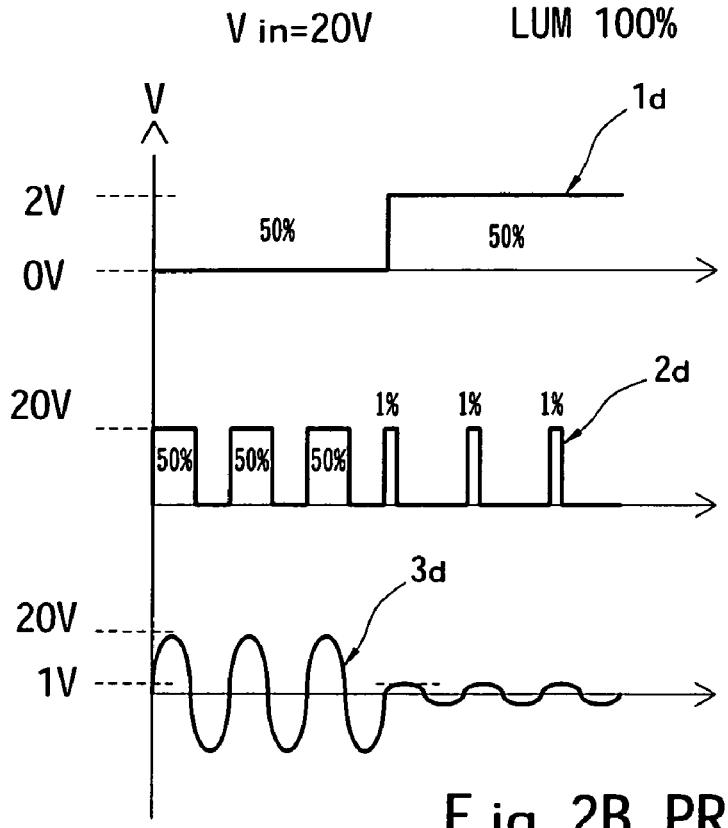
Fig.2B PRIOR ART
Figure 3A:
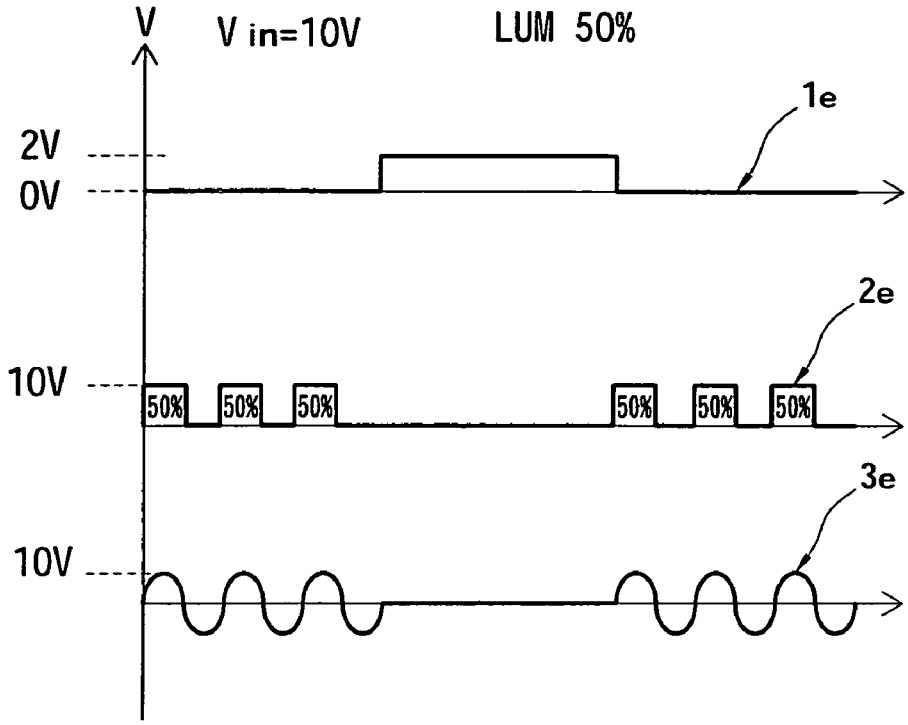
Fig.3A PRIOR ART
Figure 3B:
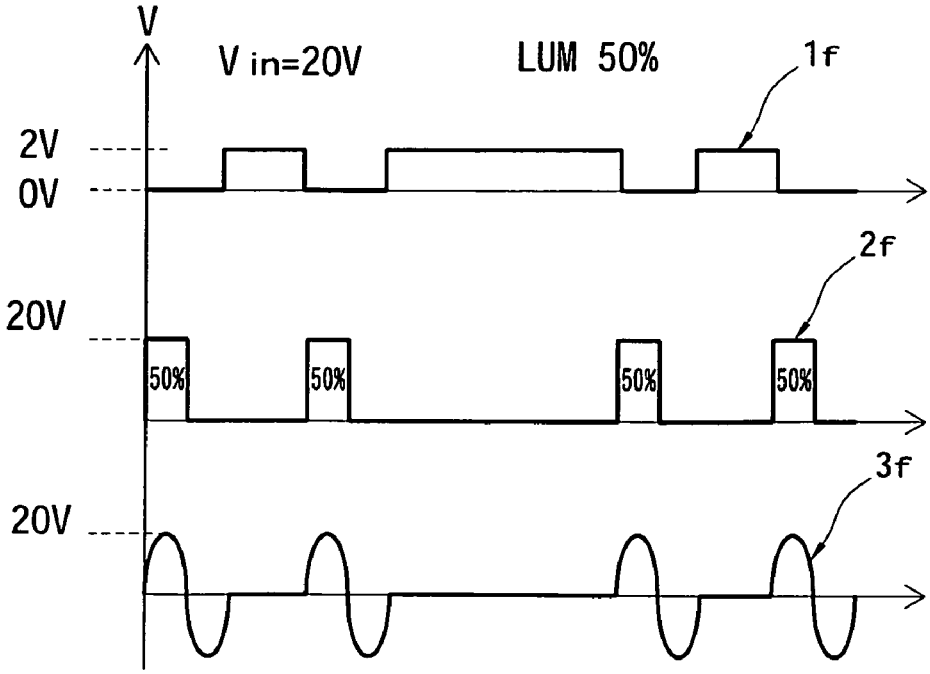
Fig.3B PRIOR ART
Figure 4A:
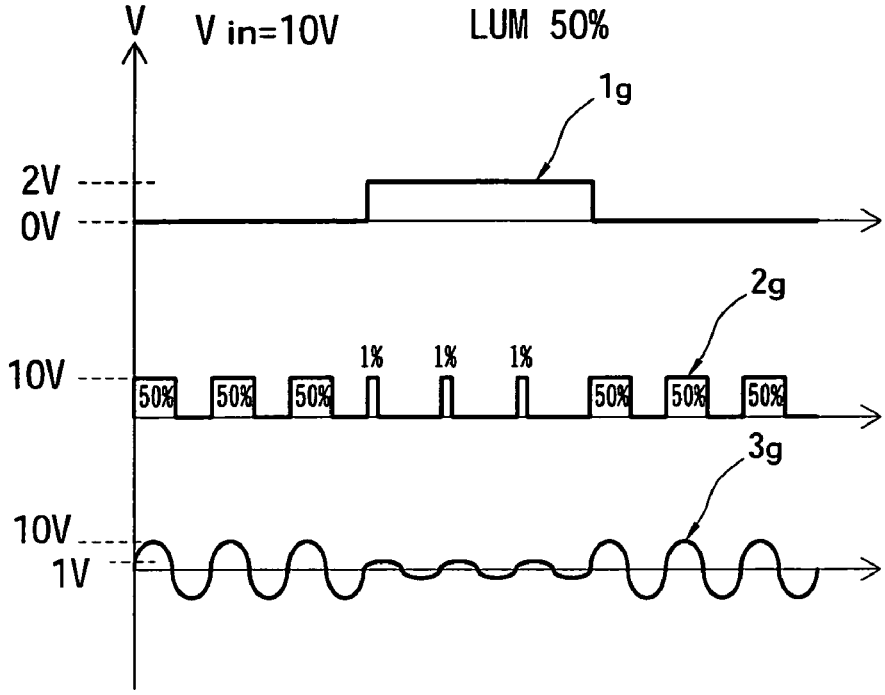
Fig.4A PRIOR ART
Figure 4B:
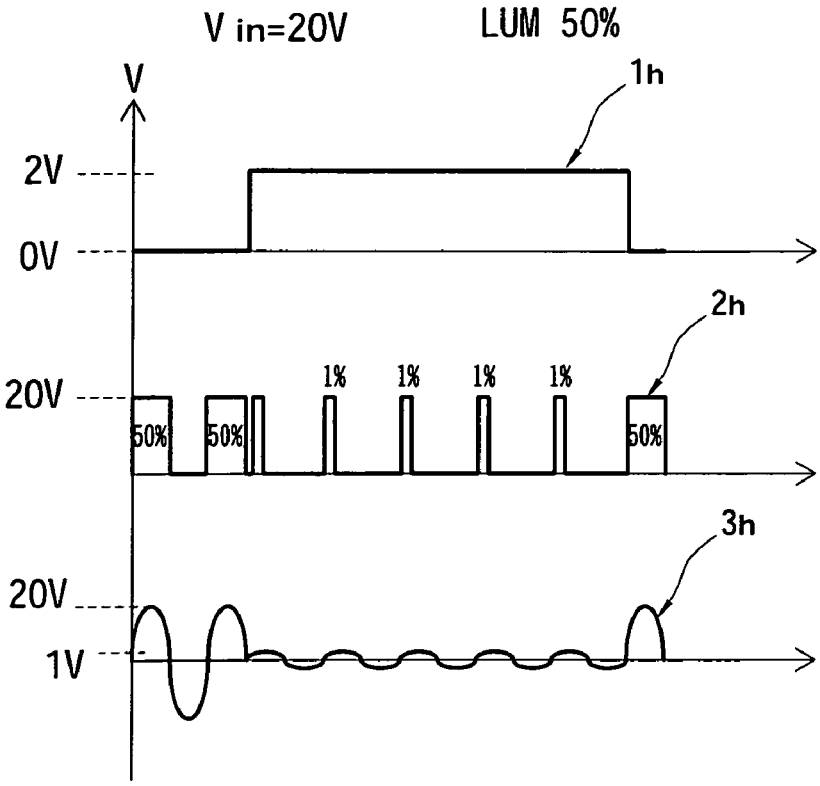
Fig.4B PRIOR ART
Figure 5A:
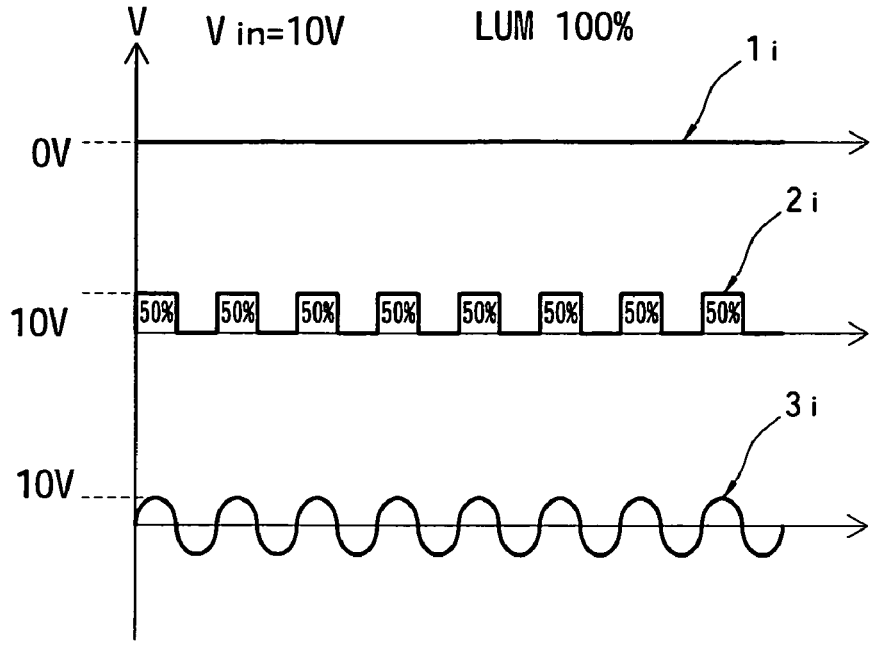
FIGS. 5A through 8B are schematic views of duty cycles of the present invention.
Figure 6A:
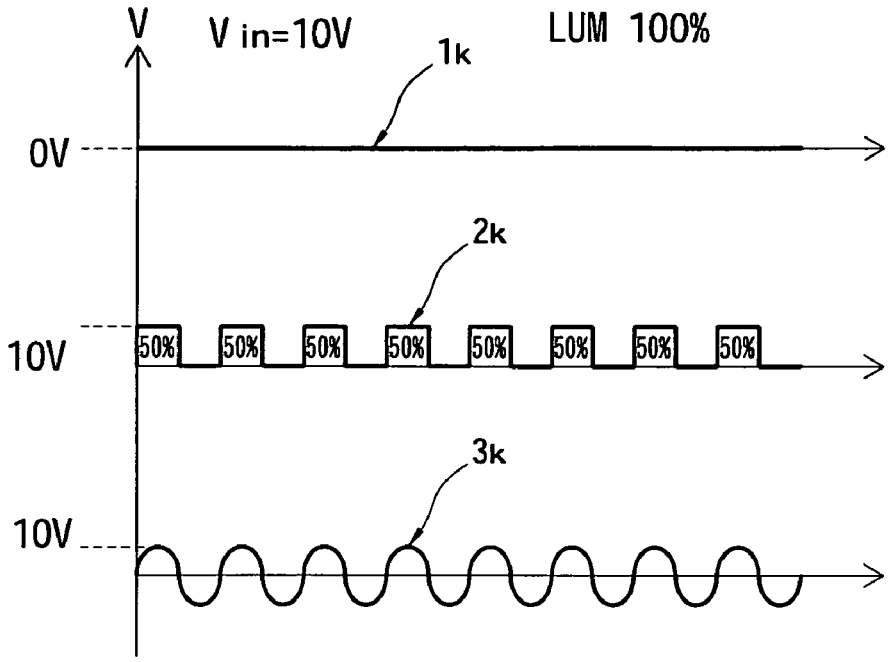
Figure 7A:
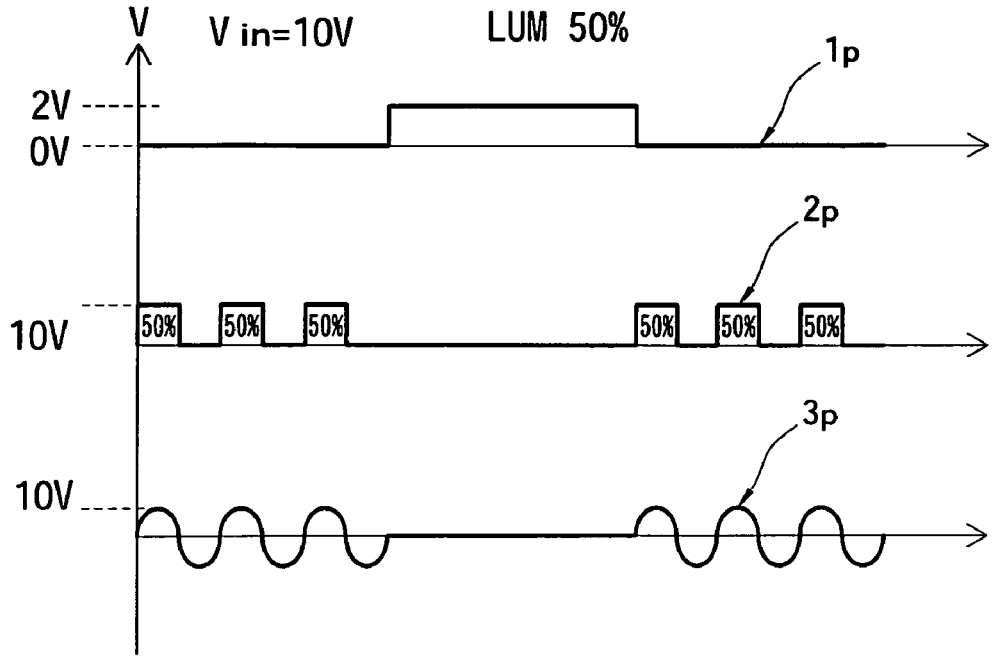
Figure 8A:
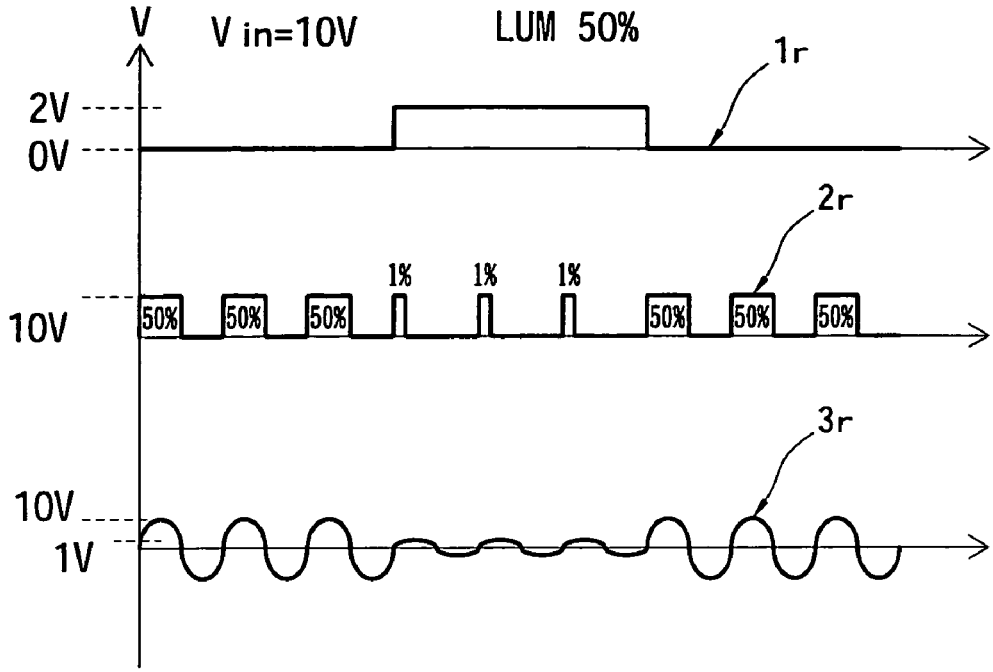

Please refer to FIGS. 5A, 6A, 9 and 10 for an embodiment of the method for controlling an inverter under altering voltage of the invention. To facilitate comparison with the conventional dimming mechanism previously discussed, the assumed conditions are same as those set forth above. However, they are not the limitation of the invention. The control method and circuit embodiment include:

A. A first controller 1 to receive an external dimming signal 11 to determine dimming duty cycles 1*i*, 1*k*, 1*p*, and 1*r*. The first controller 1 is a pulse-width modulation (PWM) impulse signal generator. The external dimming signal 11 is set by users through an external dimming knob. As shown in FIGS. 5A and 6A, the dimming duty cycles 1*i* and 1*k* are 100%. In FIGS. 7A and 8A, the dimming duty cycles 1*p* and 1*r* are 50%. In FIGS. 5A, 6A, 7A and 8A, the input voltage 7 is 10V.

B. A second controller 2 to receive the dimming duty cycles 1*l*, 1*k*, 1*p* and 1*r*, and the input voltage 7 and respond to operating conditions of a transformer 4 of an inverter to determine output electric conductive cycles 2*i*, 2*k*, 2*p* and 2*r*. The second controller 2 is a PWM frequency generator or a micro-controller 10 integrated with the first controller 1. The circuit of the embodiment adopts a piezoelectric transformer 4. Depending on the size of the input voltage 7, the second controller 2 may be coupled with a floating voltage level device 21. In FIGS. 5A and 6A, corresponding to the dimming duty cycles 1*i* and 1*k* of 100%, the electric conductive cycles 2*i* and 2*k* also are 100% ON. The electric conductive interval is 50% ON and 50% OFF. In FIGS. 7A and 8A, corresponding to the dimming duty cycles 1*p* and 1*r* of 50% , the electric conductive cycles 2*p* and 2*r* also are 50% ON and 50% OFF. The electric conductive interval is 50% ON and 50% OFF. (In FIGS. 6A and 8A, a maintenance voltage is still provided while the electric conductive interval is in the OFF condition. However, such a maintenance voltage does not affect the operation of the invention. To facilitate discussion, the variable of this maintenance voltage is omitted to avoid confusion).

C. An actuator 3 to receive the electric conductive cycles 2*i*, 2*k*, 2*p* and 2*r* to determine oscillation duty cycles 3*i*, 3*k*, 3*p* and 3*r* to be output to the transformer 4 of the inverter. The actuator 3 may be a double-switch power transistor, and generates the sinuous oscillation duty cycles 3*i*, 3*k*, 3*p* and 3*r* through the charging effect of an inductor 41. As shown in FIGS. 5A and 6A, corresponding to the dimming duty cycles 1*i* and 1*k* of 100% , the oscillation duty cycles 3*i* and 3*k* also are 100% ON. In FIGS. 7A and 8A, corresponding to the dimming duty cycles 1*p* and 1*r* of 50% , the oscillation duty cycles 3*p* and 3*r* also are 50% ON and 50% OFF.

D. When the input voltage 7 alters, the invention provides a preset reference electricity value, and compares with the input voltage 7 and outputs a modulated signal to an electricity detector 6 of the second controller 2, and according to the alteration of the input voltage 7, changes the electric conductive interval of the electric conductive cycles 2*i*, 2*k*, 2*p* and 2*r* based on the oscillation duty cycles 3*i*, 3*k*, 3*p*and 3*r* of the transformer 4 at step C. The electricity detector 6 may be a linear logic circuit containing a comparator or a comparison circuit of a micro-controller 10 integrally built in the second controller 2, or a micro-controller 10 formed by integrating the first controller 1, second controller 2 and electricity detector 6. At step D, a feedback electricity 51 may be obtained and make the union comparison with the input voltage 7 to determine the electric conductive interval of electric conductive cycles 2*j*, 2*m*, 2*q* and 2*u*. Meanwhile, the electricity detector 6 is a linear logic circuit of a window type comparator. The determination criteria of union are divided as follows:

D1: When the feedback electricity 51 and the input voltage 7 are unchanged, the dimming duty cycles 1*i*, 1*k*, 1*p* and 1*r* and the electric conductive interval of the electric conductive cycles 2*l*, 2*k*, 2*p* and 2*r* remained unchanged.

D2: When the feedback electricity 51 alters, but the input voltage 7 is unchanged, the dimming duty cycles 1*i*, 1*k*, 1*p* and 1*r* are changed according to the alteration of the feedback electricity 51. But the electric conductive interval of the electric conductive cycles 2*l*, 2*k*, 2*p* and 2*r* remained unchanged. This situation mostly occurs to the lamp current of a cold cathode lamp 5 having an abrupt and a short abnormal condition or damage. In such an occasion, return to the normal condition usually takes place. If return to the normal condition fails, the cold cathode lamp 5 could be damaged and has to be replaced.

D3: When the feedback electricity 51 remained unchanged, but the input voltage 7 alters, dimming duty cycles 1*j*, 1*m*, 1*q* and 1*u* remain unchanged. The electric conductive interval of the electric conductive cycles 2*j*, 2*m*, 2*q* and 2*u* are altered according to alteration of the input voltage 7.

D4: When the feedback electricity 51 and the input voltage 7 are changed, the dimming duty cycles 1*i*, 1*k*, 1*p* and 1*r* remain unchanged. The electric conductive interval of the electric conductive cycles 2*j*, 2*m*, 2*q* and 2*u* are altered according to alteration of the input voltage 7 if the allowing range of the actuator 3 is not exceeded. If the allowing range of the actuator 3 is exceeded, the dimming duty cycles 1*j*, 1*m*, 1*q* and 1*u* are changed according to alteration of the feedback electricity 51, and the electric conductive interval of the electric conductive cycles 2*j*, 2*m*, 2*q* and 2*u* are altered according to alteration of the input voltage 7.

Figure 5B:
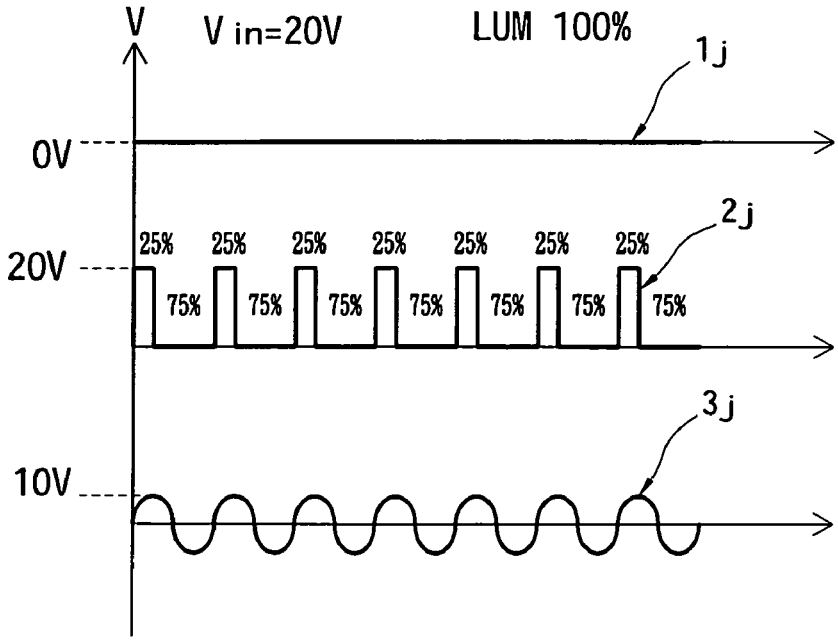
Figure 6B:
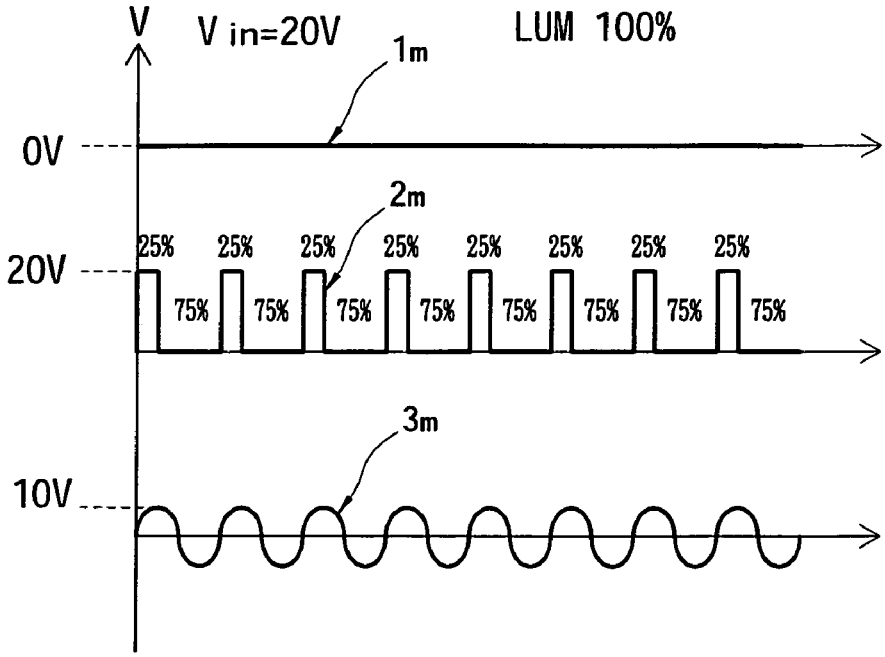
Figure 7B:
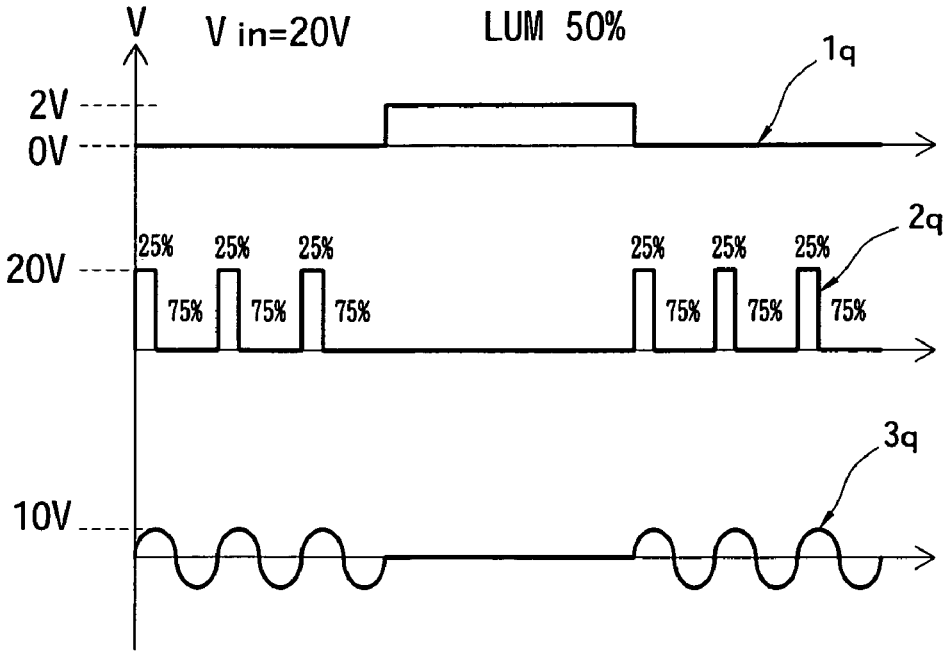
Figure 8B:
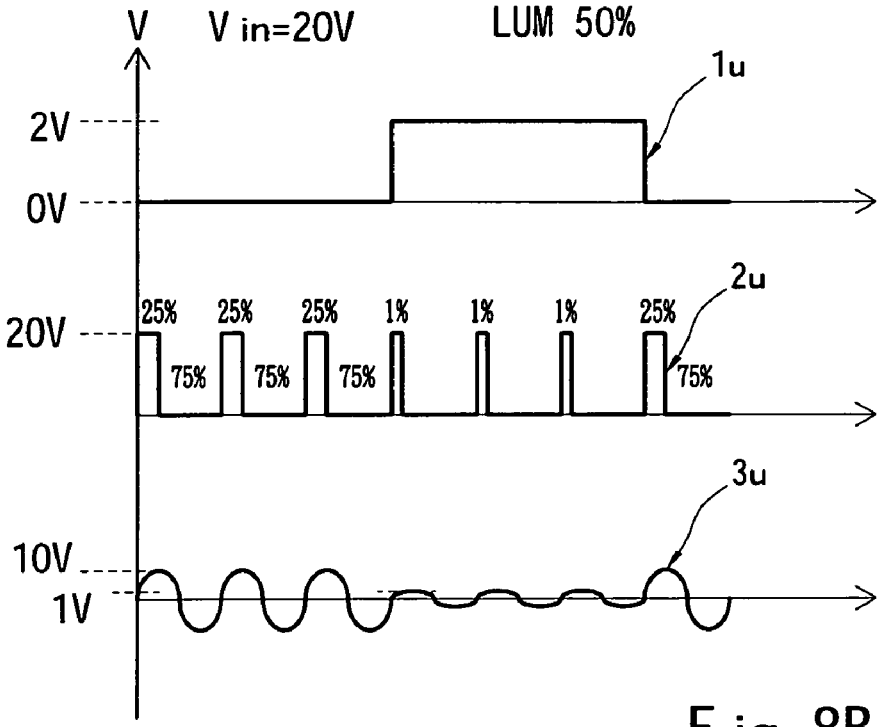
Figure 9:
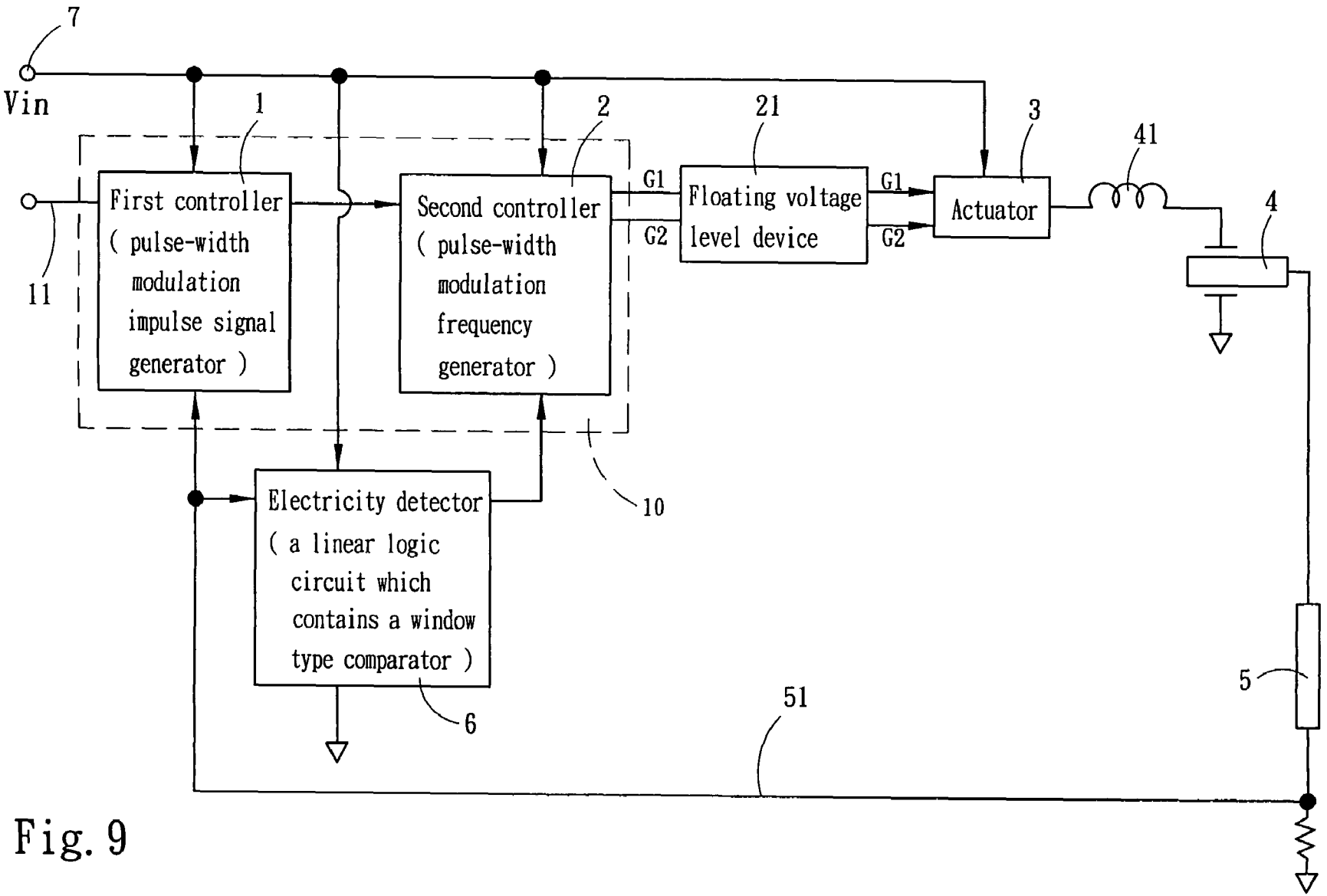
FIG. 9 is a circuit block diagram of an embodiment of the present invention.
Figure 10:
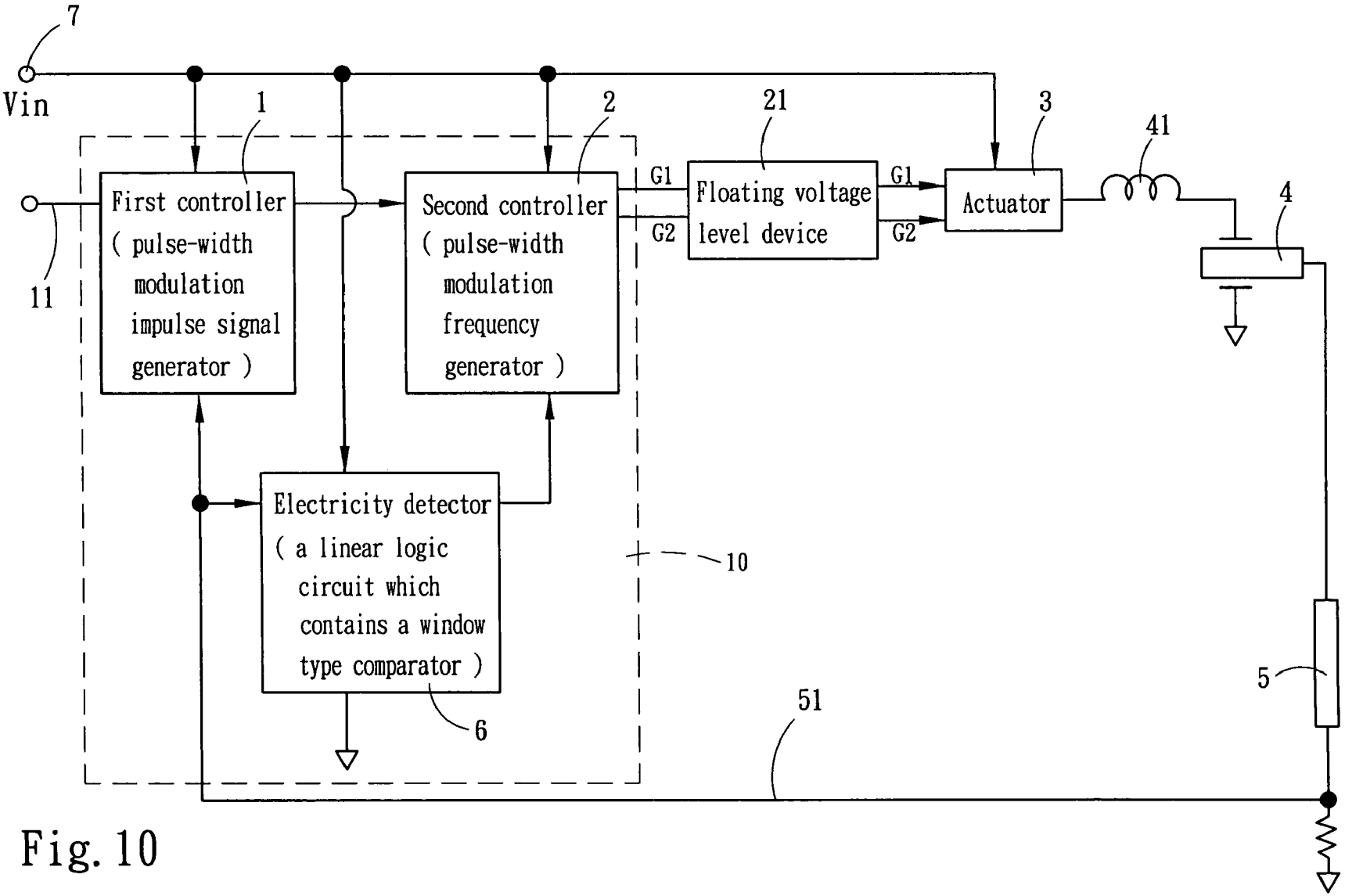
FIG. 10 is another circuit block diagram of an embodiment of the present invention.

Based on the determination criteria of D3 and D4 previously discussed, also referring to FIGS. 5B and 6B, when the input voltage 7 is changed to 20V, the dimming duty cycles 1*j*, 1*m*, 1*q* and 1*u*, and electric conductive cycles 2*j*, 2*m*, 2*q* and 2*u* do not change because of alteration of the input voltage 7. Hence the existing dimming range can be maintained. The electric conductive interval of the actuator 3 is altered from 50% ON and 50% OFF to 25% ON and 75% OFF. Alteration of the electric conductive interval shown in FIGS. 7B and 8B also adopts the same fashion.

E: The electric conductive cycles 2*j*, 2*m*, 2*q* and 2*u* are generated after the electric conductive interval depicted at step D has been altered. Under the charge and discharge effect of the inductor 41, the oscillation duty cycles 3*j*, 3*m*, 3*q* and 3*u* of the transformer 4 remain unchanged. The oscillation voltage amplitude also is maintained at 10V. Namely, the transformer 4 oscillates under the same voltage amplitude. Hence the life span of the transformer 4 can be maintained, and the lamp current of the cold cathode lamp 5 is maintained constant. Therefore blacking of one end can be reduced, and the service life of the cold cathode lamp 5 increases.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A method for controlling an inverter under altering voltage, comprising the steps of:

A. receiving an external dimming signal to determine output of a dimming duty cycle;

B. receiving the dimming duty cycle and getting an input voltage and determining output of an electric conductive cycle corresponding to operating conditions of a transformer of the inverter;

C. receiving the electric conductive cycle to determine output of the transformer oscillation duty cycle of the inverter;

D. when the input voltage alters, altering an electric conductive interval of the electric conductive cycle based on criteria of the transformer oscillation duty cycle at step C; and E. receiving the electric conductive cycle after the electric conductive interval has been altered to determine output of the transformer oscillation duty cycle of the inverter.

2. The method of claim 1, wherein the inverter includes the transformer and a control circuit which outputs the oscillation duty cycle to the transformer, the transformer receiving the input voltage to transform electricity through the oscillation duty cycle to actuate a load on a rear end, the control circuit including:

a first controller to receive the external dimming signal to determine output of the dimming duty cycle;

a second controller to receive the dimming duty cycle and determine output of the electric conductive cycle corresponding to the operating conditions of the transformer;

an actuator connecting electrically to the input voltage and receiving the electric conductive cycle to determine output of the oscillation duty cycle; and an electricity detector which has a preset reference electricity value and receives the input voltage to make comparison and output a modulation signal to the second controller to alter the electric conductive interval of the electric conductive cycle.

3. The method of claim 2, wherein the first controller is a pulse-width modulation impulse signal generator.

4. The method of claim 2, wherein the second controller is a pulse-width modulation frequency generator.

5. The method of claim 2, wherein the electricity detector is a linear logic circuit which contains a comparator.

6. The method of claim 2, wherein the first controller and the second controller are integrated to become a micro-controller.

7. The method of claim 2, wherein the second controller and the electricity detector are integrated to become a micro-controller.

8. The method of claim 2, wherein the first controller, the second controller and the electricity detector are integrated to become a micro-controller.

9. The method of claim 2, wherein the second controller is coupled to a floating voltage level device according to the input voltage.

10. The method of claim 1, wherein the step D receives a feedback electricity to make the union comparison with the input voltage to determine the electric conductive interval of the electric conductive cycle.

11. The method of claim 10, wherein the determination criteria of the step D include:

D1: maintaining the dimming duty cycle and the electric conductive interval of the electric conductive cycle unchanged when the feedback electricity and the input voltage are not altered;

D2: changing the dimming duty cycle according to alteration of the feedback electricity and maintaining the electric conductive interval of the electric conductive cycle unchanged when the feedback electricity is altered and the input voltage is not altered;

D3: maintaining the dimming duty cycle unchanged and altering the electric conductive interval of the electric conductive cycle according to alteration of the input voltage when the feedback electricity remains unchanged but the input voltage is altered; and D4: maintaining the dimming duty cycle unchanged and altering the electric conductive interval of the electric conductive cycle according to alteration of the input voltage when the feedback electricity and the input voltage are altered.

12. The method of claim 11, wherein the determination criteria at D4 include changing the dimming duty cycle according to alteration of the feedback electricity and changing the electric conductive interval of the electric conductive cycle according to alteration of the input voltage.

13. The method of claim 10, wherein the inverter includes the transformer and a control circuit which outputs the oscillation duty cycle to the transformer, the transformer receiving the input voltage to transform electricity through the oscillation duty cycle to actuate a load on a rear end, the control circuit including:

a first controller to receive the external dimming signal to determine output of the dimming duty cycle;

a second controller to receive the dimming duty cycle and determine output of the electric conductive cycle corresponding to the operating conditions of the transformer;

an actuator connecting electrically to the input voltage and receiving the electric conductive cycle to determine output of the oscillation duty cycle; and an electricity detector which has a preset reference electricity value and receives the input voltage to make comparison and output a modulation signal to the second controller to alter the electric conductive interval of the electric conductive cycle.

14. The method of claim 13, wherein the first controller is a pulse-width modulation impulse signal generator.

15. The method of claim 13, wherein the second controller is a pulse-width modulation frequency generator.

16. The method of claim 13, wherein the electricity detector is a linear logic circuit which contains a window type comparator.

17. The method of claim 13, wherein the first controller and the second controller are integrated to become a micro-controller.

18. The method of claim 13, wherein the second controller and the electricity detector are integrated to become a micro-controller.

19. The method of claim 13, wherein the first controller, the second controller and the electricity detector are integrated to become a micro-controller.

20. The method of claim 13, wherein the second controller is coupled to a floating voltage level device according to the input voltage.

* * * * *